US010707041B2

(12) United States Patent
Reuber et al.

(10) Patent No.: US 10,707,041 B2
(45) Date of Patent: Jul. 7, 2020

(54) SWITCHING DEVICE FOR MEDIUM VOLTAGE ELECTRIC POWER DISTRIBUTION INSTALLATIONS

(71) Applicant: ABB Schweiz AG, Baden (CH)

(72) Inventors: Christian Reuber, Willich (DE); Luciano Di Maio, Milan (IT); Gabriele Valentino De Natale, Milan (IT)

(73) Assignee: ABB Schweiz AG, Baden (CH)

( * ) Notice: Subject to any disclaimer, the term of this patent is extended or adjusted under 35 U.S.C. 154(b) by 93 days.

(21) Appl. No.: 15/919,248

(22) Filed: Mar. 13, 2018

(65) Prior Publication Data

US 2018/0261416 A1 Sep. 13, 2018

(30) Foreign Application Priority Data

Mar. 13, 2017 (EP) ..... 17160581

(51) Int. Cl.
*H01H 33/66* (2006.01)
*H01H 71/10* (2006.01)
(Continued)

(52) U.S. Cl.
CPC ..... *H01H 71/10* (2013.01); *H01F 7/02* (2013.01); *H01F 27/28* (2013.01); *H01H 33/38* (2013.01);
(Continued)

(58) Field of Classification Search
CPC ..... H01H 71/10
(Continued)

(56) References Cited

U.S. PATENT DOCUMENTS 4,086,645 A * 4/1978 Gorman ..... H01H 33/285 218/154
6,020,567 A * 2/2000 Ishikawa ..... H01H 3/28 218/120
(Continued)

FOREIGN PATENT DOCUMENTS

EP 2975617 A1 1/2016
FR 2943840 A1 10/2010
WO 2016042803 A1 3/2016

OTHER PUBLICATIONS

European Patent Office, Extended Search Report issued in corresponding Application No. 17160581.9, dated Jul. 31, 2017, 8 pp.

*Primary Examiner* — Alexander Talpalatski
(74) *Attorney, Agent, or Firm* — Taft Stettinius & Hollister LLP; J. Bruce Schelkopf

(57) ABSTRACT

A switching device including: one or more fixed contacts and one or more movable contacts, each movable contact being reversibly movable between an opening position, at which the movable contact is decoupled from a corresponding fixed contact, and a closing position, at which the movable contact is coupled with the corresponding fixed contact; an electromagnetic actuator adapted to actuate the movable contacts between the opening and closing positions, the electromagnetic actuator including a fixed yoke and a movable armature operatively associated with the fixed yoke to form a magnetic circuit, the movable armature being reversibly movable between a first position, which corresponds to the opening position of the movable contacts, and a second position, which corresponds to the closing position of the movable contacts; and a kinematic chain to operatively connect the movable armature with the movable contacts, wherein the electromagnetic actuator includes a first excitation coil and a second excitation coil wound around the fixed yoke. The switching device further include
(Continued)

a first power drive circuit adapted to provide a first excitation current to the first excitation coil and a second power drive circuit adapted to provide a second excitation current to the second excitation coil; the first and second power drive circuits are galvanically separated one from another and capable of operating independently one from another.

18 Claims, 17 Drawing Sheets

(51) Int. Cl.

| | |
|---|---|
| ***H01F 27/28*** | (2006.01) |
| ***H01F 7/02*** | (2006.01) |
| ***H01H 33/666*** | (2006.01) |
| ***H01H 33/38*** | (2006.01) |
| *H01H 9/00* | (2006.01) |
| *H01F 7/16* | (2006.01) |
| *H01F 7/06* | (2006.01) |
| *H01F 7/18* | (2006.01) |
| *H01H 3/28* | (2006.01) |

(52) U.S. Cl.
CPC ..... *H01H 33/6662* (2013.01); *H01F 7/064* (2013.01); *H01F 7/1615* (2013.01); *H01F 7/1646* (2013.01); *H01F 7/1844* (2013.01); *H01F 7/1877* (2013.01); *H01F 2007/1669* (2013.01); *H01F 2007/1692* (2013.01); *H01H 3/28* (2013.01); *H01H 2009/0083* (2013.01); *H01H 2205/002* (2013.01)

(58) Field of Classification Search
USPC ..... 218/120, 154
See application file for complete search history.

(56) References Cited

U.S. PATENT DOCUMENTS

| | | | | |
|---|---|---|---|---|
| 6,373,675 | B1 * | 4/2002 | Yamazaki | H01H 33/6662 200/237 |
| 7,843,293 | B1 * | 11/2010 | Bonjean | H01H 3/28 218/154 |
| 9,508,514 | B2 * | 11/2016 | Ohda | H01H 33/38 |
| 2017/0125182 | A1 | 5/2017 | Yoshida et al. | |

* cited by examiner

SWITCHING DEVICE FOR MEDIUM VOLTAGE ELECTRIC POWER DISTRIBUTION INSTALLATIONS

The present invention relates to the field of the switching devices for medium voltage electric power distribution installations, such as circuit breakers, contactors, disconnectors, reclosers or the like.

More particularly, the present invention relates to a medium voltage switching device of the electromagnetic type.

For the purposes of the present invention, the term medium voltage (MV) identifies voltages higher than 1 kV AC and 1.5 kV DC up to tens of kV, e.g. up to 72 kV AC and 100 kV DC.

As is known, a MV switching device of the electromagnetic type comprises an electromagnetic actuator for coupling or uncoupling its electric contacts during switching operations.

Typically, the electromagnetic actuator comprises a magnetic core provided with an excitation coil and a movable armature mechanically coupled to the movable contacts of the switching device.

During a manoeuvre of the switching device, an excitation current flows along the excitation coil and generates a magnetic flux that interacts with the magnetic core and the movable armature. A magnetic force is generated to move the movable armature according to a desired direction.

A MV switching device of electromagnetic type generally comprises a power drive circuit to provide a suitable excitation current to the excitation coil of the electromagnetic actuator.

Typically, the power drive circuit comprises a network of power switches (e.g. MOSFETs or IGBTs) arranged according to a H-bridge configuration.

A known example of a MV switching device of electromagnetic type is described in the patent EP2312605B1.

As is known, some electric power distribution installations, which are dedicated to critical environments or are aimed at providing top-level performances, require the arrangement of MV switching devices of the electromagnetic type capable of ensuring high levels of reliability.

Typical examples of these installations are represented by subsea switchgears including switching devices (e.g. vacuum circuit breakers) of the electromagnetic type to switch a MV electric power supply to subsea electric loads (e.g. to subsea electric motors) installed in deep water (3000 m or more) facilities.

Common MV switching devices of the electromagnetic type are generally unable of providing the high levels of reliability required by these electric power distribution installations.

In fact, the probability of failure of some components (e.g. the power drive circuit or the turns of the excitation coil) of these devices is often incompatible with the required reliability levels.

On the other hand, the design of switching devices ensuring satisfactory levels of reliability, e.g. by including redundant arrangements of the most critical components, has proven to be quite difficult to carry out.

Known solutions, which have been proposed up to now, have the drawback of being quite complex from a structural point of view and expensive to manufacture at industrial level.

Therefore, in the market, it is still quite felt the demand for MV switching devices of the electromagnetic type capable of showing high performance levels in terms of reliability and, at same time, characterized by a remarkable structural simplicity.

In order to satisfy this need, the present invention provides a switching device for medium voltage electric power distribution installations, according to the following claim 1 and the related dependent claims.

In a further aspect, the present invention relates to an electric power distribution installation, according to the following claim 18.

Characteristics and advantages of the present invention will become more apparent from the detailed description of preferred embodiments illustrated only by way of non-limitative example in the accompanying drawings, in which.

Figure 1:
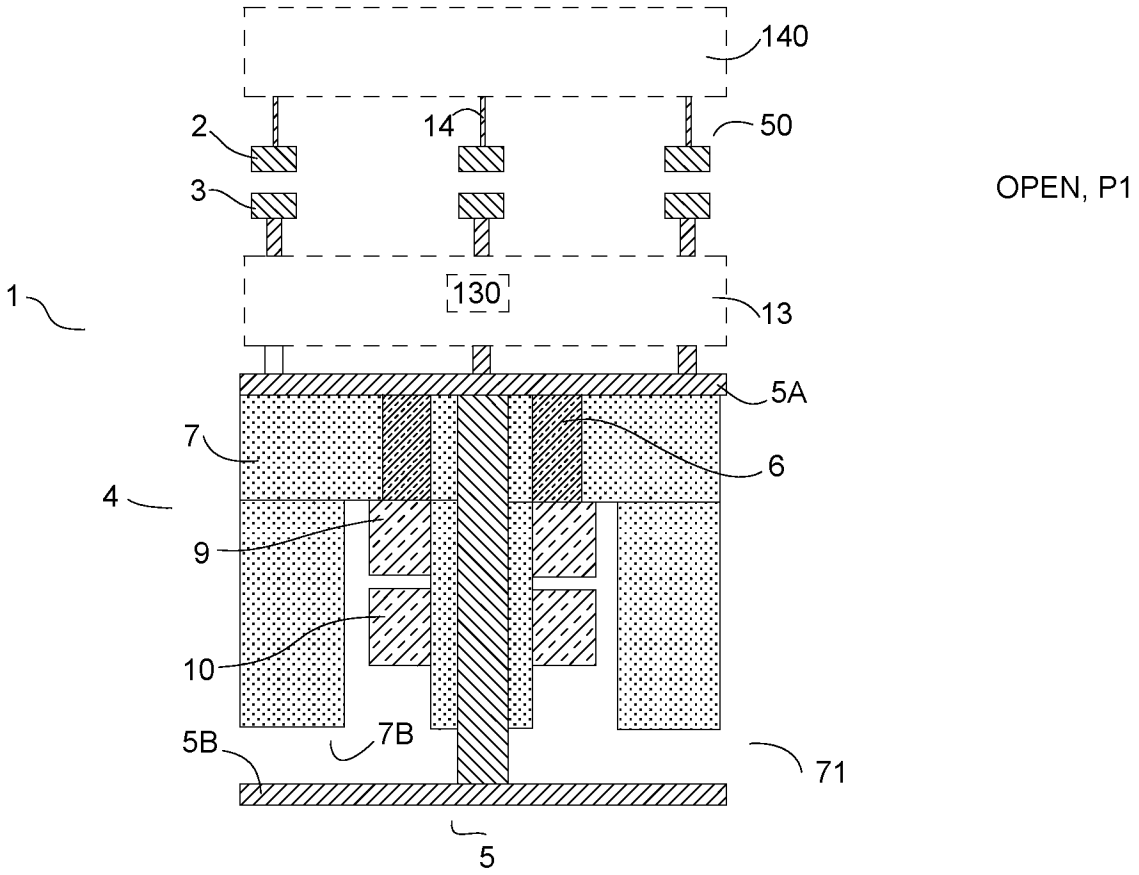
FIGS. 1-8 are block diagrams that schematically show a MV switching device, according to the invention.
Figure 2:
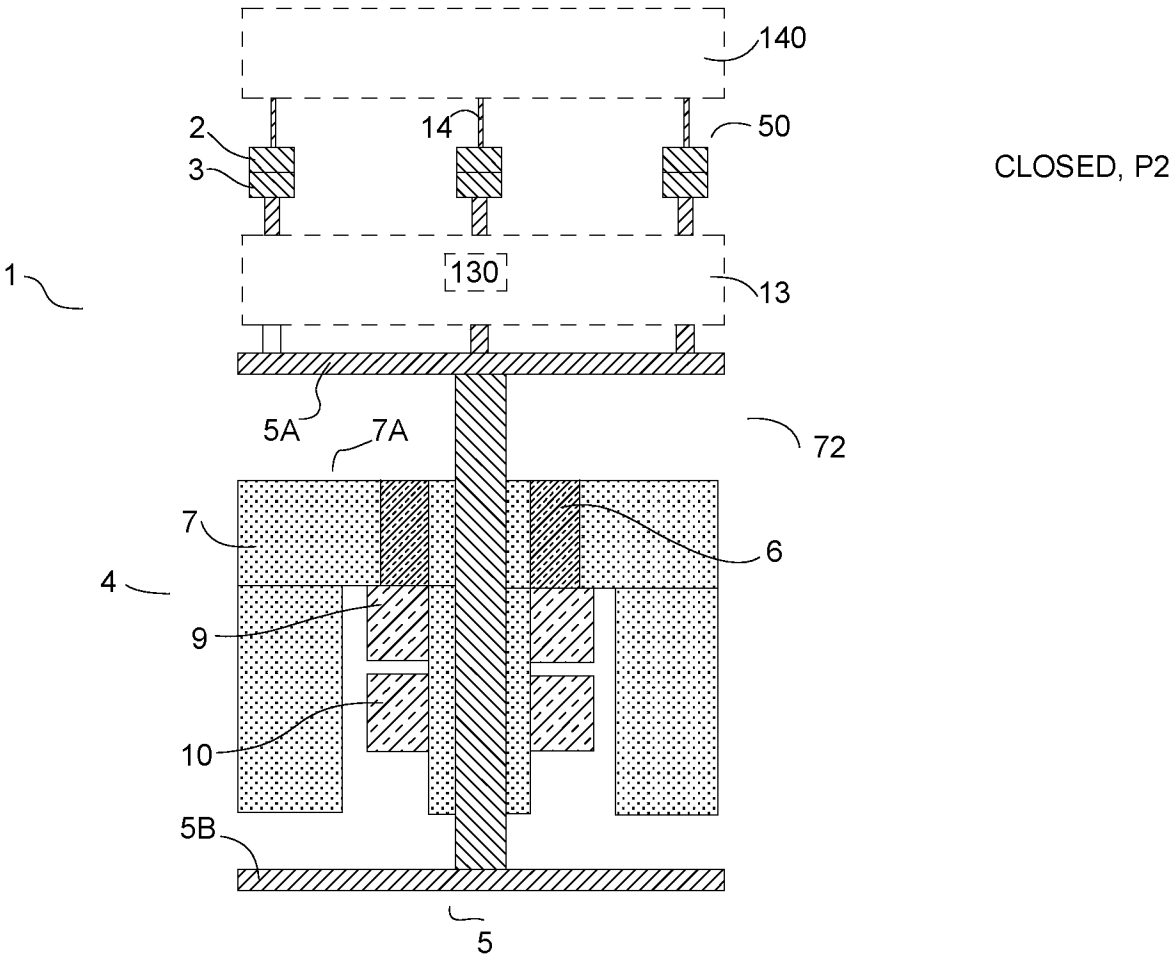

Referring to FIGS. 1 and 2, the present invention is related to a MV switching device 1.

The switching device 1 comprises one or more electric poles 50, each of which comprises a movable contact 3 and a fixed contact 2 electrically connectable to a respective conductor 14 (e.g. a phase conductor) of a power distribution line 140.

Each movable contact 3 is reversibly movable between an opening position OPEN, at which it is decoupled from the corresponding fixed contact 2, and a closing position CLOSED, at which it is coupled with the corresponding fixed contact 2.

The electric contacts 2, 3 are configured to be coupled or uncoupled during the switching manoeuvers of the switching device 1.

A switching manoeuver may be a closing manoeuver, in which the contacts 2, 3 are brought from an uncoupled state to a coupled state, or an opening manoeuver, in which the contacts 2, 3 are brought from a coupled state to an uncoupled state.

When the contacts 2, 3 are in a coupled or uncoupled state, the switching device 1 is in a closing or an opening condition, respectively.

The switching device 1 can be of the single-phase or of the multi-phase type. In the cited figures, it is shown as the three-phase type, as an example.

The switching device 1 comprises an electromagnetic actuator 4 adapted to move the movable contacts 3 between the opening and closing positions OPEN, CLOSED, in other words during the switching manoeuvers of the switching device 1.

The electromagnetic actuator 4 comprises a fixed yoke 7 forming a magnetic circuit.

The fixed yoke 7 is at least partially magnetic. As an example, it may be at least partially made of a ferromagnetic material (e.g. Fe or Fe, Si, Ni, Co alloys).

The electromagnetic actuator 4 comprises a movable armature 5 operatively associated to the fixed yoke 7 to form a magnetic circuit.

Also the movable armature 5 is at least partially magnetic. As an example, it may be at least partially made of a ferromagnetic material.

Preferably, the movable armature 5 has a reversed-H structure having a first plate 5A and a second plate 5B, which are mutually spaced and positioned proximally and distally with respect to the movable contacts 2 of the switching device 1, respectively at opposite first and second sides 7A, 7B of the magnetic yoke 7.

In general, the structural arrangement of the fixed yoke 7 and of the movable armature 5 may be of known type and will not be further described in further details for the sake of brevity.

The movable armature 5 is reversibly movable, according to suitable translation directions, between a first position P1, which corresponds to the opening position OPEN of the movable contacts 3, and a second position P2, which corresponds to the closing position CLOSED of the movable contacts 3.

The switching device 1 comprises a kinematic chain 13 that operatively connects the movable armature 5 with the movable contacts 3 so that these latter are moved by forces imparted by the movable armature during the switching manoeuvers of the switching device 1.

The kinematic chain 13 may be of known type and will not be described in further details for the sake of brevity.

According to preferred embodiments of the invention (as shown in the cited figures), the electromagnetic actuator 4 comprises one or more permanent magnets 6 to generate a bias magnetic flux to maintain the movable armature 5 in the first position P1 or in the second position P2. The movable contacts can thus be hold the OPEN and CLOSED positions without electrical excitation and external mechanical latches.

The permanent magnets 6 may be arranged according to solutions of known type, which are here not described for the sake of brevity.

According to preferred embodiments of the invention (as shown in the cited figures), the switching device 1 comprises one or more opening springs 130 (e.g. arranged in the electromagnetic actuator or in the kinematic chain 13 as shown in FIGS. 1-2) to provide the mechanical energy to move the movable contacts 3 with a suitable speed during an opening maneuver of the switching device 1.

The opening springs 130 may be arranged according to solutions of known type, which are here not described for the sake of brevity.

The electromagnetic actuator 4 comprises a first excitation coil 9 and a second excitation coil 10, which are wound around a same section of the fixed yoke 7.

In practice these two coils form a double coil as they excite a same section of the yoke 7 and their turns can be wound on the same bobbin.

Referring to the embodiment of the switching device 1 shown in FIGS. 1-2, the operation of the electromagnetic actuator 4 in normal conditions is briefly discussed in the following.

During a closing manoeuvre of the switching device 1 (movable contacts moving from the OPEN position to the CLOSED position), excitation currents IC1 and/or IC2 are injected in the excitation coils 9 and/or 10. Said excitation currents are directed in such a way to generate a magnetic flux concordant with the magnetic flux generated by the permanent magnets 6. In this way, a magnetic force capable of moving the movable armature 5 from the first position P1 to the second position P2 is generated. Such a magnetic force overcomes a retaining force exerted by the permanent magnets 6 (which magnetically interacts with the first plate 5A of the movable armature 5) and an opposite mechanical force exerted by the opening springs 130, which are thus charged during said closing manoeuvre.

When the switching device 1 is in a close condition (CLOSED position of the movable contacts), the movable armature 5 is maintained in the second position P2 by the magnetic force exerted by the permanent magnets 6, which magnetically interacts with the second plate 5B of the movable armature 5. The magnetic force generated by the permanents magnets 6 overcomes an opposite mechanical force exerted by the charged opening springs 130.

During an opening manoeuvre of the switching device 1 (movable contacts moving from the CLOSED position to the OPEN position), excitation currents IC1 and/or IC2 are injected in the excitation coils 9 and/or 10. Said excitation currents are directed in such a way to generate a magnetic flux discordant with the magnetic flux generated by the permanent magnets 6, which magnetically interacts with the second plate 5B of the movable armature 5. In this way, the overall magnetic force exerted on the movable armature 5 is reduced. When said magnetic force is reduced to a level lower than the opposite mechanical force exerted by the charged opening springs 130, the movable armature 5 is moved by said opening springs from the second position P2 to the first position P1.

When the switching device 1 is in an open condition (OPEN position of the movable contacts), the movable armature 5 is maintained in the first position P1 by the magnetic force 6 generated by the permanent magnets 6, which magnetically interacts with the first plate 5A of the movable armature 5.

Figure 3:
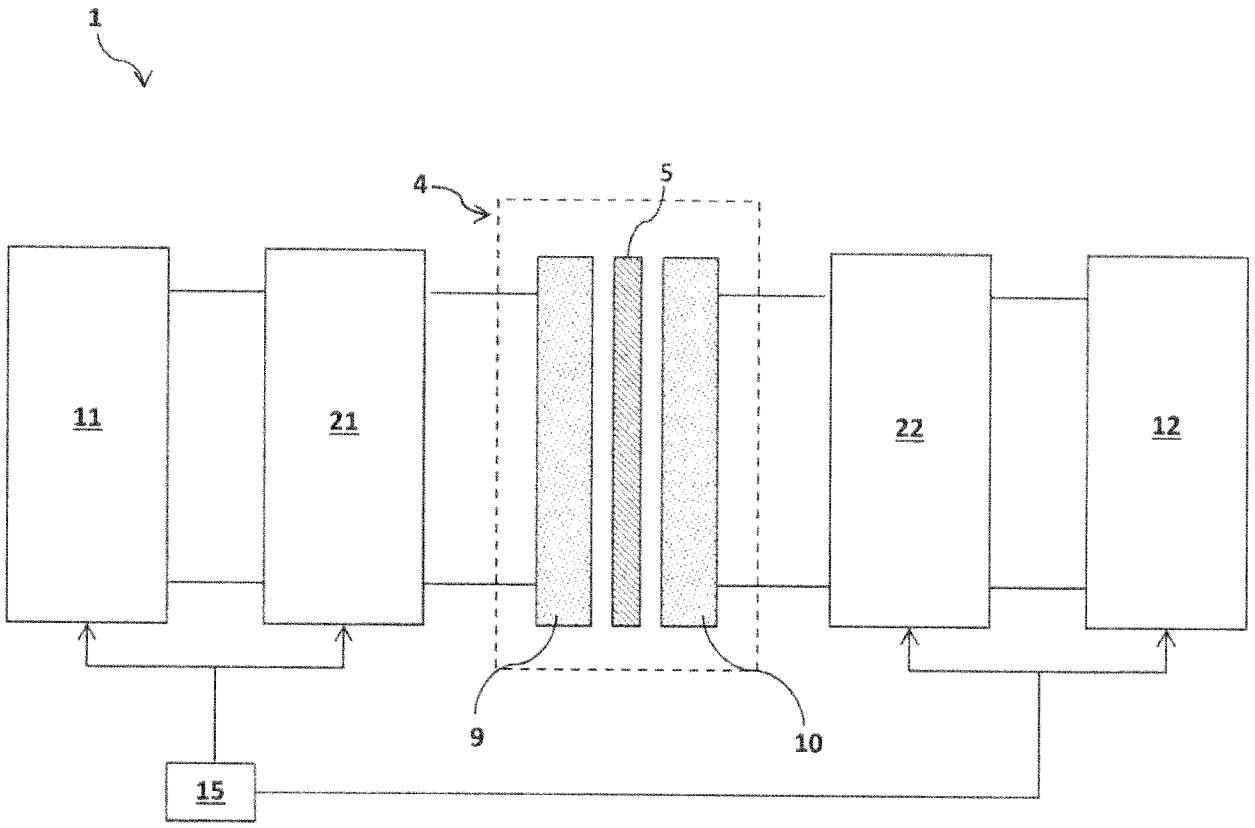
Figure 4:
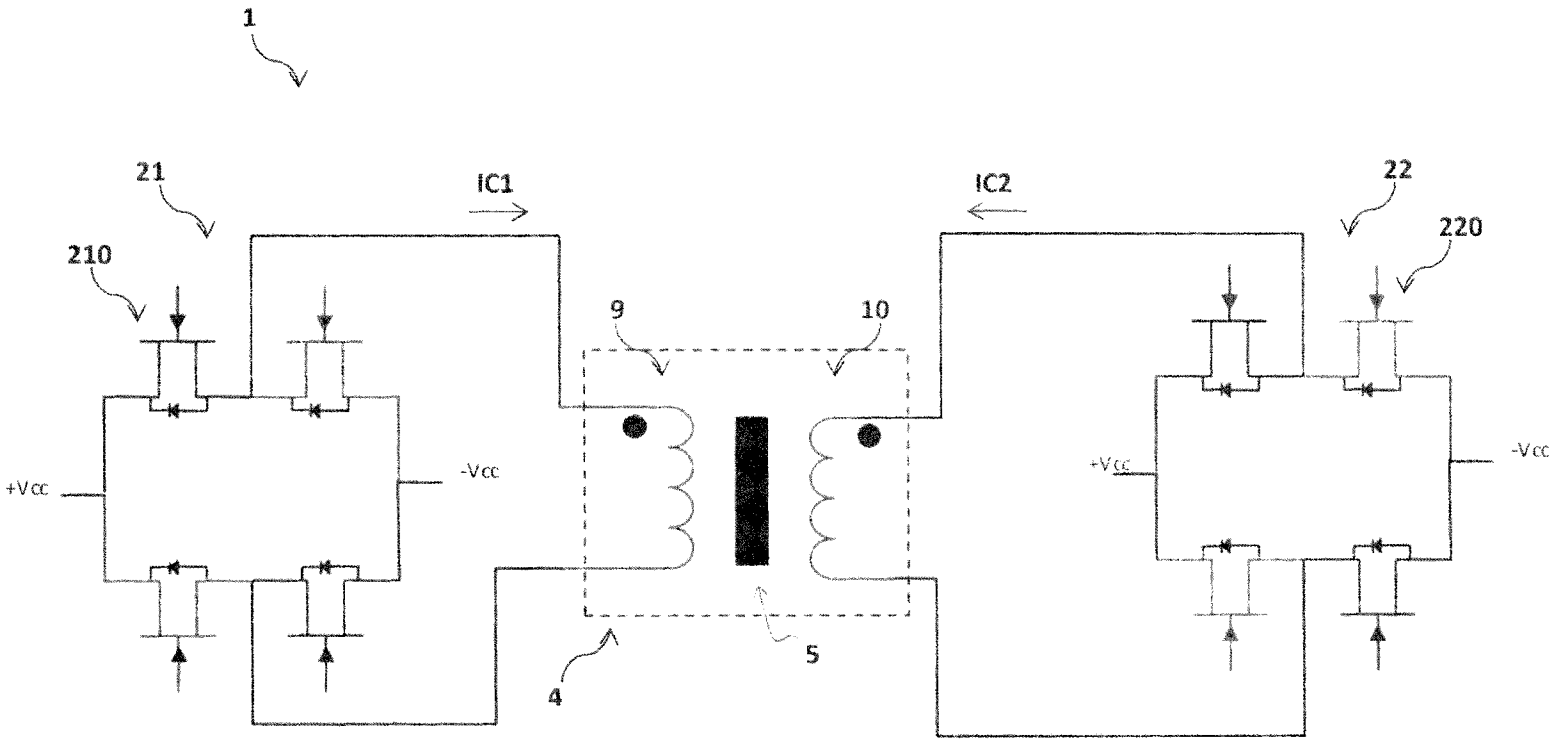

Referring to FIGS. 3 and 4, the switching device 1 further comprises a first power drive circuit 21 adapted to drive the first excitation coil 9 by providing a first excitation current IC1 to said first excitation coil and a second power drive circuit 22 adapted to drive the second excitation coil 10 by providing a second excitation current IC2 to said second excitation coil.

According to the invention, the first and second power drive circuits 21, 22 are galvanically separated one from another and capable to operate independently one from another.

For the sake of clarity, it is specified that the first and second power drive circuits 21, 22 are galvanically separated one from another in the sense that no conduction paths are permitted or present between said circuits.

It is further specified that the first and second power drive circuits 21, 22 operate independently one from another in the sense that each power drive circuit is capable of driving the corresponding excitation coil without having any functional relation with the other power drive circuit.

As an example, each power drive circuit 21, 22 is capable of driving the corresponding excitation coil even if the other power drive circuit is switched off or subject to a failure.

Preferably, each power drive circuit 21, 22 comprises a plurality of corresponding power switches 210, 220 (e.g. a MOSFET or an IGBT) arranged according to a H-bridge circuit configuration.

Each power drive circuit 21, 22 thus comprises circuit branch portions configured to allow/block the flow of a current depending on the control signals received by said power switches (at the respective gate or base terminals).

Each power drive circuit 21, 22 is therefore capable of providing a positive or a negative excitation current IC1, IC2 (the sign depends on the adopted sign convention) to the respective excitation coil 9, 10, according to the needs.

Preferably, the switching device 1 comprises control means 11, 12 to control the first and second power drive circuits 21, 22.

Preferably, said control means comprises a first controller 11 to control the first power drive circuits 21 and a second controller 12 to control the second power drive circuit 22.

Preferably, the first and second controllers 11, 12 are configured to interact so that they can mutually exchange control/data signals.

Other solutions are possible, according to the needs. For example, the control means 11, 12 may comprise a single controller capable of controlling both the first and second power drive circuits 21, 22.

Preferably, the control means 11, 12 comprises one or more computerized units (e.g. microprocessors) configured to execute software instructions to generate control and/or data signals to manage the operation of the power drive circuits 21, 22 and, possibly, to perform other functions.

Preferably, the control means 11, 12 are operatively associated (e.g. by suitable electrical wirings or in other known manners) to the power drive circuits 21, 22 so that they send suitable control signals to these latter.

As an example, when a switching manoeuvre has to be executed, the control means 11, 12 send control signals to the corresponding power switches 210, 220 of the power drive circuits 21, 22 so that these latter provide suitable excitation currents IC1, IC2 to the excitation coils 9, 10 to operate the movable armature 5.

Preferably, the control means 11, 12 are electrically connected to the corresponding power switches 210, 220 of the power drive circuits 21, 21 and are configured to provide control signals to said power switches (at the gate or base terminals thereof), so that each power switch is switchable between an ON state, at which it allows the flow of a current along the corresponding branch portion, and an OFF state, at which it blocks the flow of a current along said corresponding branch portion.

Preferably, the switching device 1 comprises power supply means 15 to supply electric power to the control means 11, 12 and to the power drive circuits 21, 22 (and consequently to the excitation coils 9, 10).

Preferably, the power supply means 15 comprise an auxiliary power supply (which may be of known type) adapted to provide electric power to the control means 11, 12 and to the power drive circuits 21, 22 (and consequently to the excitation coils 9, 10) in normal conditions.

Preferably, such an auxiliary power supply is adapted to harvest electric power directly from the electric line 140 to which the switching device 1 is operatively associated.

Preferably, the power supply means 15 comprise electric energy storage means (which may be of known type) adapted to provide electric power in emergency conditions, e.g. when the above mentioned electric line is interrupted.

Preferably, such electric energy storage means comprise a storage capacitor that is continuously charged by the mentioned auxiliary power supply.

In emergency conditions (e.g. due to a fault), said storage capacitor is no more charged and it is thus capable of providing electric power to the control means 11, 12 and to the power drive circuits 21, 22 for a residual time interval only, during which the switching device 1 can execute an emergency manoeuvre.

Alternatively, and depending on the required level of redundancy of the application, the power supply means 15 can also be redundant, so that one power supply means 15 is foreseen exclusively for the power drive circuit 21 and its control means 11, and a second power supply means 15 is foreseen exclusively for the power drive circuit 22 and its control means 12.

According to an aspect of the invention, the first and second drive circuits 21, 22 are adapted to drive the first and second excitation coils 9, 10 so that both the excitation currents IC1, IC2 provided to said excitation coils by said drive circuits contribute to generate a magnetic flux to move the movable armature 5 between the first and second positions P1, P2, when the operation of said first and second coils is not affected by a failure (e.g. by a failure in the first and second excitation coils 9, 10 themselves and/or in the first and second power drive circuits 21, 22 and/or in the first and second controllers 11, 12).

In other words, the first and second excitation coils 9, 10 are adapted to be driven by the respective power drive circuits 21, 22 so that both of them are capable to cooperate to generate a magnetic flux to move the movable armature 5 between the first and second positions P1, P2, when no failures occur (normal conditions).

For the sake of clarity, it is specified that the excitation coils 9, 10 contribute or cooperate to generate a the magnetic flux in the sense that the excitation currents IC1, IC2 flowing along them generate, at least for a period of time, corresponding concordantly oriented magnetic fluxes, which add up to generate the resulting magnetic flux interacting with the fixed yoke 7 and the movable armature 5 and generating a magnetic force to move said movable armature between the first and second positions P1, P2.

According to an aspect of the invention, each of the first and second drive circuits 21, 22 is adapted to drive the respective first excitation coil 9 or second excitation coil 10, so that the excitation current IC1 flowing along the first excitation coil 9 or the excitation current IC2 flowing along the second excitation coil 10 generates by itself a magnetic flux to move the movable armature 5 between the first and second positions P1, P2, when the operation of the other excitation coil is affected by a failure.

In more details:

- the first drive circuit 21 is adapted to drive the first excitation coil 9 so that the excitation current IC1 flowing along this latter generates by itself a magnetic flux to move the movable armature between the first and second positions P1, P2, when the operation of the second excitation coil 10 is affected by a failure (e.g. by a failure in the second excitation coil 10 itself and/or in the second power drive circuits 22 and/or in the second controller 12);
- the second drive circuit 22 is adapted to drive the second excitation coil 10 so that the second excitation current IC2 flowing along this latter generates by itself a magnetic flux to move the movable armature 5 between the first and second positions P1, P2, when the operation of the first excitation coil 9 is affected by a failure (e.g. by a failure in the first excitation coil 9 itself and/or in the first power drive circuits 21 and/or in the first controller 11).

Preferably, as shown in FIG. 4, the excitation coils 9, 10 are electrically connected with a same polarity with the outputs of the corresponding power drive circuits 21, 22.

In this case, both the excitation coils 9, 10 will be fed with positive or negative excitation currents IC1, IC2 and they will both contribute, at least partially, to generate a resulting magnetic flux oriented towards a given direction or an opposite one, if no failures occur.

Preferably, the excitation coils 9, 10 are advantageously arranged so that a balancing of the magnetic forces exerted on the movable armature 5 is obtained, when both the excitation coils 9, 10 operate to move the movable armature 5.

Figure 7:
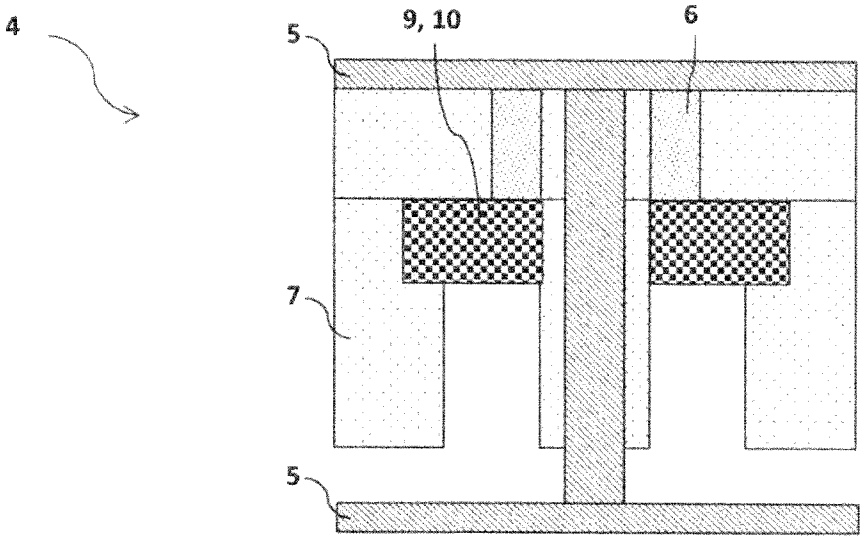
Figure 8:
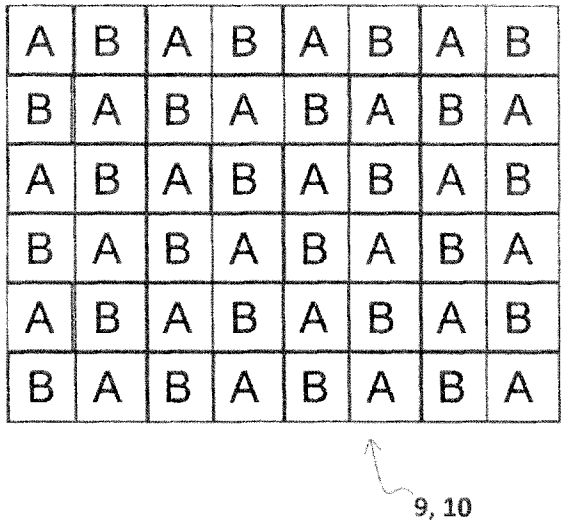

According to an embodiment shown in FIGS. 7-8, the first and second excitation coils 9, 10 have the respective first and second turns A, B arranged according to an interlaced winding layout.

This winding layout ensures an optimal balance of the magnetic forces exerted on the movable armature 5 and, at the same time, an optimal coupling between the excitation coils 9, 10, as they were the windings of a transformer of the 1:1 type. This last property may be suitable used for intelligent sensing of the operative status of the excitation coils or of the movements of the movable armature 5.

Figure 5:
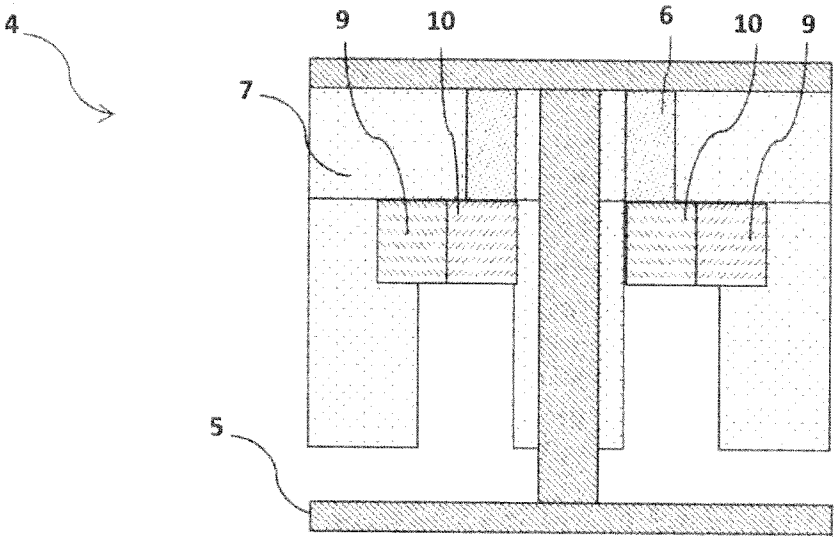
Figure 6:
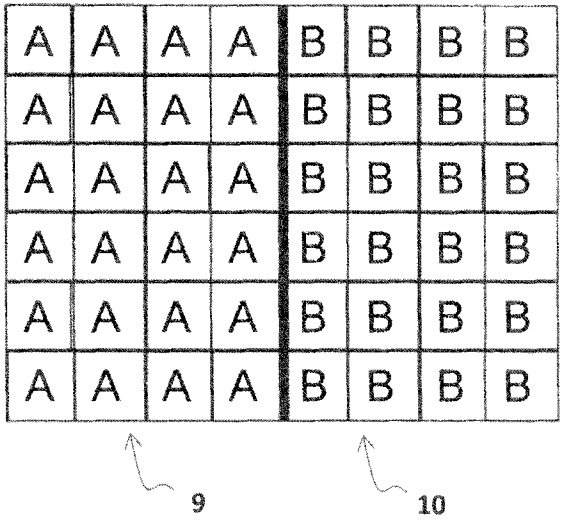

According to an embodiment shown in FIGS. 5-6, the first and second excitation coils 9, 10 have the respective first and second turns A, B arranged according to a side-by-side concentric winding layout.

This winding layout ensures a lower balance of the magnetic forces exerted on the movable armature 5 with respect to the previously illustrated solution. However, this arrangement allows reducing the overall volumes occupied by the excitation coils 9, 10.

The operation of the switching device 1, according to the embodiments shown in the cited figures, is now briefly described in more details.

Opening State of the Switching Device

When the switching device 1 is an opening state:

- the movable contacts 3 are in the opening position OPEN, thereby being decoupled from the fixed contacts 2.
- the movable armature 5 is in the first position P1 and is separated from the fixed yoke 7 by an airgap 71 at a second side 7B of the fixed yoke 7;
- the control means 11, 12 provide control signals to the power drive circuits 21, 22 to block any current flow towards the excitation coils 9, 10;
- the excitation coils 9, 10 are not fed with excitation currents IC1, IC2 provided by the respective power circuits 21, 22.

The movable armature 5 is hold in the first position P1 by the magnetic force exerted by the permanent magnets 6, which magnetically interacts with the first plate 5A of the movable armature 5 to prevent the formation of airgaps between said plate and the fixed yoke 7 at the first side 7A of this latter.

Closing Manoeuvre of the Switching Device

To perform a closing manoeuvre of the switching device 1, the control means 11, 12 provide control signals to the power circuits 21, 22 so that these latter feed the excitation coils 9, 10 with suitable excitation currents IC1, IC2 (conventionally, the excitation currents IC1, IC2 have a positive sign referring to the embodiment shown in FIG. 4).

More particularly, the power circuits 21, 22 provide one or more suitable launch pulses of the excitation currents IC1, IC2 to the excitation coils 9, 10.

In normal conditions, the excitation coils 9, 10 are driven by the corresponding power drive circuits 21, 22, so that both of them contribute to generate a resulting magnetic flux that circulates along the magnetic circuit formed by the fixed yoke 7 and the movable armature 5.

As the fixed yoke 7 and the movable armature 5 are initially separated by an airgap 71 at the second side 7B of the magnetic yoke, a magnetic force is exerted on the movable armature to close such an airgap.

The movable armature thus moves from the first position P1 to the second position P2.

Consequently, the movable contacts 3 moves from the opening position OPEN to the closing position CLOSED.

If a failure affects the operation of one of the excitation coils 9, 10 during the closing manoeuvre, the remaining excitation coil 9 or 10 is driven by the corresponding power drive circuit 21 or 22 so as to be capable to generate by itself the magnetic flux to move the movable armature 5.

The amplitude and the duration of the launch pulses of the first and second excitation currents IC1, IC2 are advantageously set to obtain a magnetic force sufficiently high to move the movable armature 5 for a given distance with a suitable speed.

The amplitude and the duration of the launch pulses of first and second excitation currents IC1, IC2 are advantageously set to overcome the retaining magnetic force exerted by the permanent magnets 6 on the movable armature 5 (to avoid the formation of an airgap between the magnetic yoke 7 and the first plate 5A at the first side 7A of the magnetic yoke) and also the opposing mechanical force exerted (directly or indirectly) by the opening springs 130 on the movable armature 5. The opening springs 130 thus store elastic energy during the movement of the movable armature 5.

Closing State of the Switching Device

When the switching device 1 is a closing state:

- the movable contacts 3 are in the closing position CLOSED, thereby being coupled with the fixed contacts 2.
- the movable armature 5 is in the second position P2 and is separated from the fixed yoke 7 by an airgap 72 at the first side 7A of the fixed yoke 7;
- the control means 11, 12 provide control signals to the power circuits 21, 22 to block any current flow towards the excitation coils 9, 10;
- the excitation coils 9, 10 are not fed with excitation currents ICE IC2 provided by the respective power circuits 21, 22;
- the opening springs 130 are charged.

The movable armature 5 is hold in the second position P2 by the magnetic force exerted by the permanent magnets 6, which magnetically interacts with the second plate 5B of the movable armature 5 to prevent the formation of airgaps between said plate and the fixed yoke 7 at the second side 7B of this latter.

Opening Manoeuvre of the Switching Device

To perform an opening manoeuvre of the switching device 1, the control means 11, 12 provide control signals to the power circuits 21, 22 such that these feed the excitation coils 9, 10 with suitable excitation currents IC1, IC2 (conventionally, the excitation currents IC1, IC2 have a negative sign referring to the embodiment shown in FIG. 4).

More particularly, the power circuits 21, 22 provide suitable launch pulses of the excitation currents IC1, IC2 to the excitation coils 9, 10.

In normal conditions, the excitation coils 9, 10 are driven by the corresponding power drive circuits 21, 22, so that both of them generate a magnetic flux circulating along the magnetic circuit formed by the fixed yoke 7 and the movable armature 5.

Such a magnetic flux has an opposite direction with respect to the magnetic flux generated by the permanent magnets 6.

The magnetic retaining force of the permanent magnets 6 is thus reduced.

When said retaining force becomes lower than the mechanical force exerted by the charged opening springs 130, the opening springs 130 can release the stored elastic energy and move the movable armature from the second position P2 to the first position P1.

Consequently, the movable contacts 3 moves from the closing position CLOSED to the opening position OPEN.

If a failure affects one of the excitation coils 9, 10 during the opening manoeuvre, the remaining excitation coil 9 or 10 is driven by the corresponding power drive circuit 21 or 22 so as to be capable to generate by itself the magnetic flux to move the movable armature 5.

The amplitude and the duration of the launch pulses of the first and second excitation currents IC1, IC2 are advantageously set to obtain a suitable opening speed of the movable contacts.

The control means 11, 12 are preferably configured to control the power drive circuits 21, 22 so that the excitation coils 9, 10 are driven according to redundant driving strategies by the power drive circuits 21, 22 to perform the opening or closing manoeuvers of the switching device.

Figure 10:
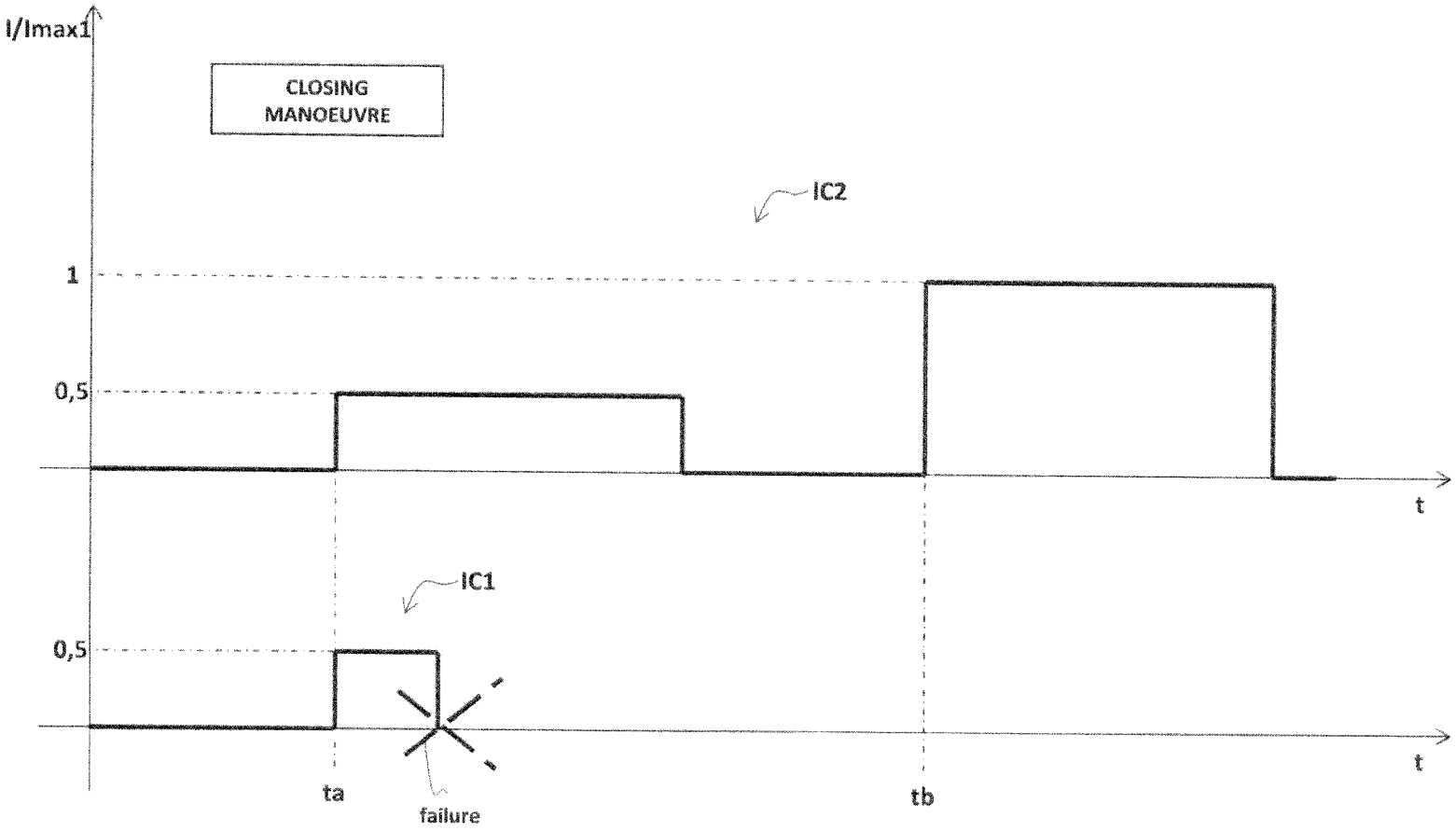
Figure 11:
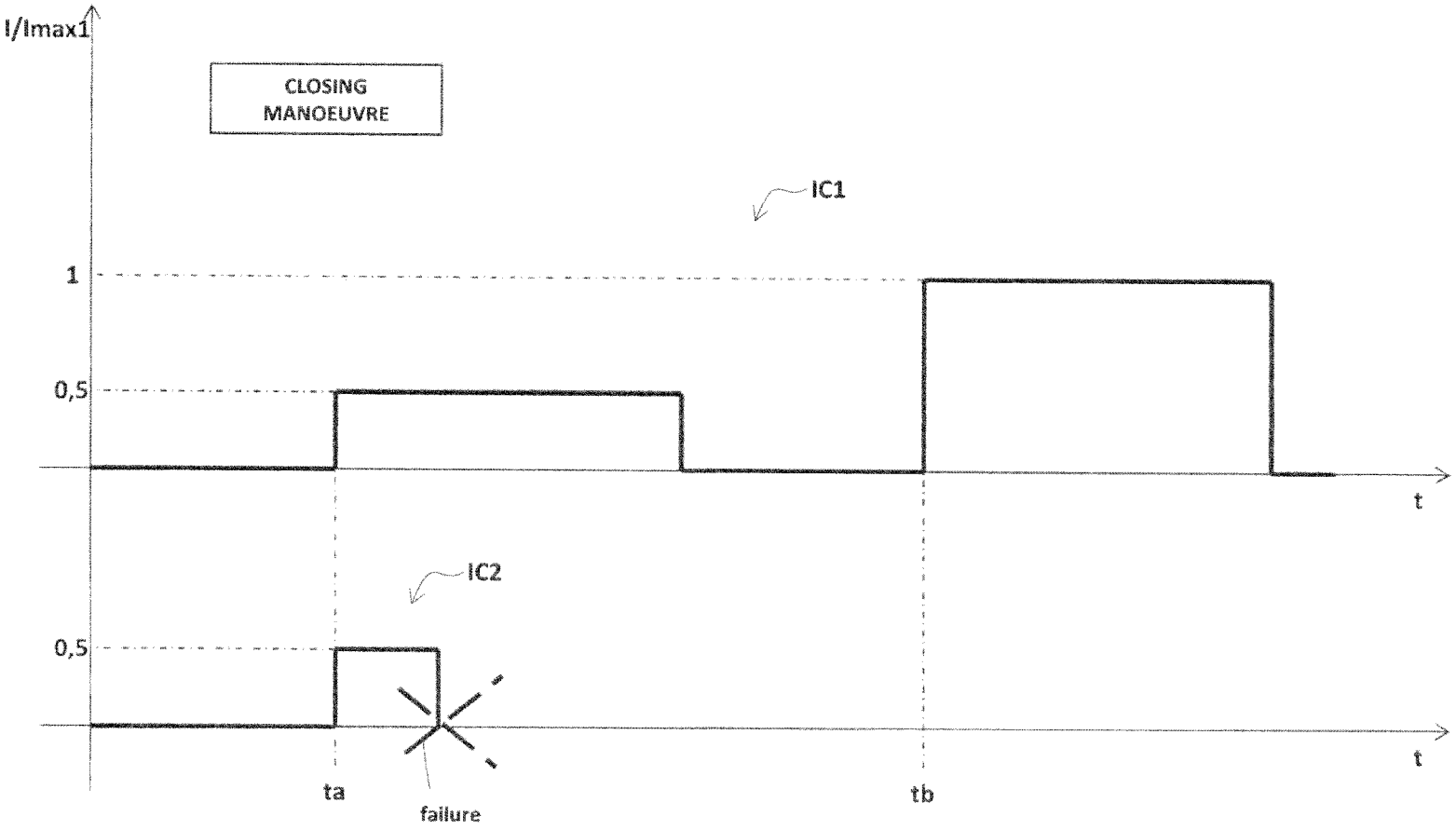

A possible driving strategy to drive the excitation coils 9, 10 to perform a closing manoeuver of the switching device 1 is now described with reference to FIGS. 9-11.

Conventionally, the excitation currents IC1, IC2 have a positive sign referring to the embodiment shown in FIG. 4.

According to this driving strategy, the first and second power drive circuits 21, 22 provide launch pulses of the first and second excitation currents IC1, IC2, which start at a same launch instant to and which have a same amplitude IL (lower than the possible maximum amplitude) and, preferably, a same duration TL. In this way, during the closing manoeuvre, a good balance of the magnetic forces exerted on the movable armature 5 is obtained and over-stresses on the mechanical parts are reduced.

More particularly, according to such a driving strategy:

the first power drive circuit 21 provides a launch pulse of the first excitation current IC1 at a first launch instant ta. Said launch pulse of the first excitation current IC1 has an amplitude IL lower than the amplitude of the excitation current Imax1 needed to move the movable armature 5;

the second power drive circuit 22 provides a launch pulse of the second excitation current IC2 at the first launch instant ta. Said launch pulse of the second excitation current IC2 has an amplitude IL lower than the excitation current Imax1 needed to move the movable armature 5.

Conveniently, the sum of the amplitudes of the launch pulses of the first and second excitation pulses IC1, IC2 are equal to the amplitude of excitation current Imax1 needed to move the movable armature 5.

Preferably, the amplitude and duration of the second launch pulse of the second excitation current IC2 is equal to the amplitude and duration of the first launch pulse of the first excitation current IC1.

Figure 9:
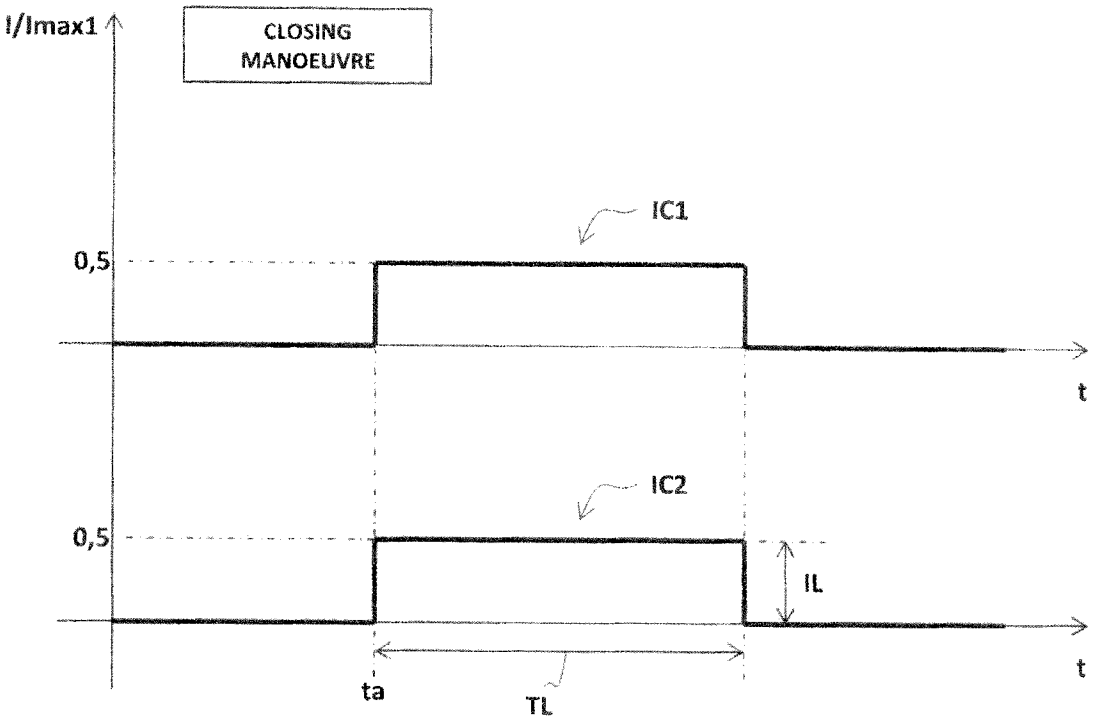
FIGS. 9-14 are block diagrams that schematically show possible operation modes of the MV switching device, according to the invention.

According to the above driving strategy, in normal conditions (i.e. if no failures occur in the excitation coils 9, 10 and/or in the power drive circuits 21, 22 and/or in the first and second controllers 11, 12), both the excitation coils 9, 10 provide a simultaneous and balanced contribution (in terms of magnetic force) to move the movable armature 5 during the overlapping time (TL) between the launch pulses of the first and second excitation currents IC1, IC2 (FIG. 9).

Preferably, if a failure affects the operation of one of the excitation coils 9, 10 during the closing manoeuvre, the above driving strategy provides for further driving the excitation coil 9 or 10, which is not affected by such a failure, so that this latter provides the mechanical force to move the movable armature 5 by itself. In this way, the safe completion of the closing manoeuvre is ensured.

More particularly, according to such a driving strategy:

if a failure affects the first excitation coil 9 (e.g. it occurs in the first excitation coil 9 and/or in the first power drive circuit 21 and/or in the first controller 11), the second power drive circuit 22 provides a further launch pulse of the second excitation current IC2 at a second launch instant tb (following the launch instant ta). In this case, said further launch pulse of the second excitation current IC2 has an amplitude IL equal to (100%) the amplitude of the excitation current Imax1 needed to move the movable armature 5 (FIG. 10); or if a failure affects the second excitation coil 10 (e.g. it occurs in the second excitation coil 10 and/or in the second power drive circuit 22 and/or in the second first controller 12), the first power drive circuit 21 provides a further launch pulse of the first excitation current IC1 at a second launch instant tb (following the launch instant ta). In this case, said further launch pulse of the first excitation current IC1 has an amplitude IL equal to (100%) the amplitude of the maximum excitation current Imax1 needed to move the movable armature 5 (FIG. 11).

A further possible driving strategy to drive the excitation coils 9, 10 to perform a closing manoeuver of the switching device 1 is now described with reference to FIGS. 12-13.

Conventionally, the excitation currents IC1, IC2 have a positive sign referring to the embodiment shown in FIG. 4.

According to this driving strategy, the first and second power drive circuits 21, 22 provide launch pulses of the first and second excitation currents IC1, IC2, which start at following launch instants ta, tb (separated by a time interval Td) and which have a same amplitude IL (equal to the possible maximum amplitude) and, preferably, a same duration TL.

In this way, during the closing manoeuvre, over-stresses on the mechanical parts are further reduced and the safe completion of the closing manoeuvre is ensured, even if a failure affects one of the excitation coils.

More particularly, according to such a driving strategy:

said first power drive circuit 21 provides a launch pulse of the first excitation current IC1 at a first launch instant ta. Said first launch pulse of the first excitation current IC1 has an amplitude equal to (100%) the amplitude of the excitation current Imax1 needed to move the movable armature 5;

the second power drive circuit 22 provides a second launch pulse of the second excitation current IC2 at a second launch instant tb. Said launch pulse of the second excitation current has an amplitude equal (100%) to the amplitude of the excitation current Imax1 needed to move the movable armature 5.

The first and second launch instants ta, tb are separated by a given time interval Td that is shorter than the duration of the first one (intended as timing order) of the launch pulses of the first and second excitation currents IC1, IC2.

The timing order of the launch instants ta, tb may be any, according to the needs.

Figure 12:
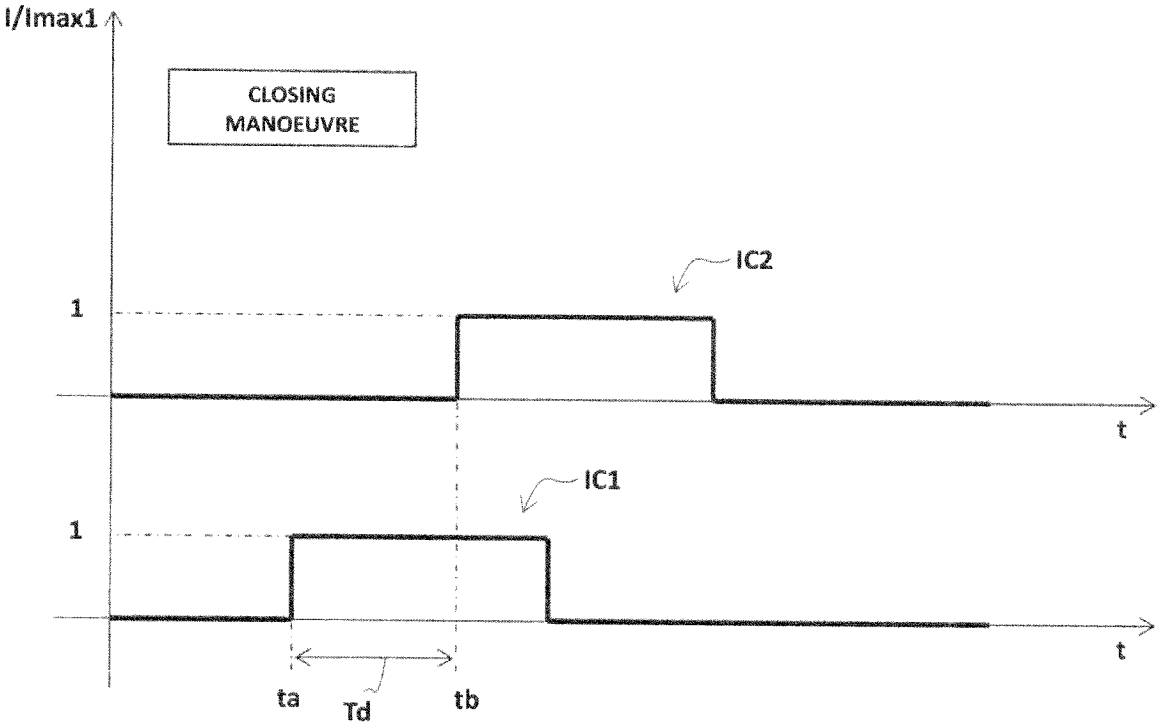
Figure 13:
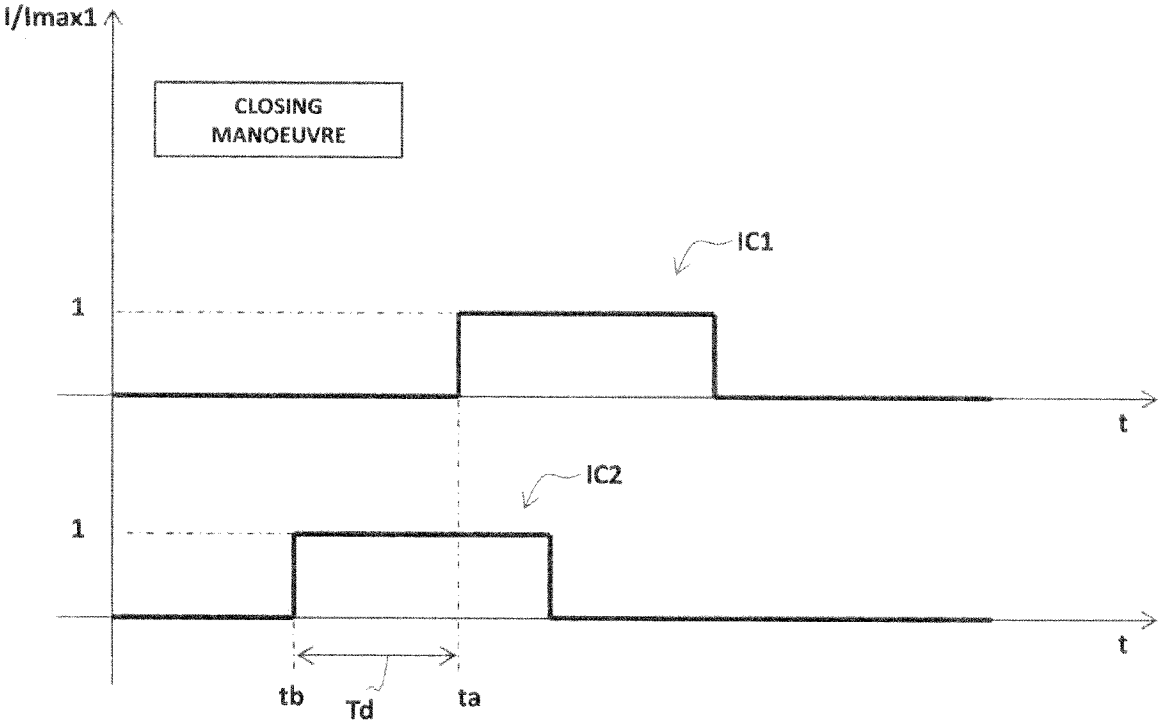

In the example shown in FIG. 12, the first launch instant ta precedes the second launch instant tb whereas in the example shown in FIG. 12, the first launch instant ta follows the second launch instant tb.

In normal conditions, the excitation coils 9, 10 cooperate to generate the magnetic flux to move the movable armature 5 only during the overlapping time (TL−Td) between the subsequent launch pulses of the first and second excitation currents IC1, IC2.

It is evident that if a failure affects the operation of one of the excitation coils 9, 10, the closing manoeuvre of the switching device is completed by the other excitation coil, which is not affected by failures. At most, a time delay equal to the time interval Td may occur.

Preferably, the time interval Td is longer than or equal to the closing time Tc (i.e. the time needed to perform the closing manoeuvre) of the switching device 1.

This last feature may be suitably used for intelligent sensing of the movements of the movable armature 5.

Figure 14:
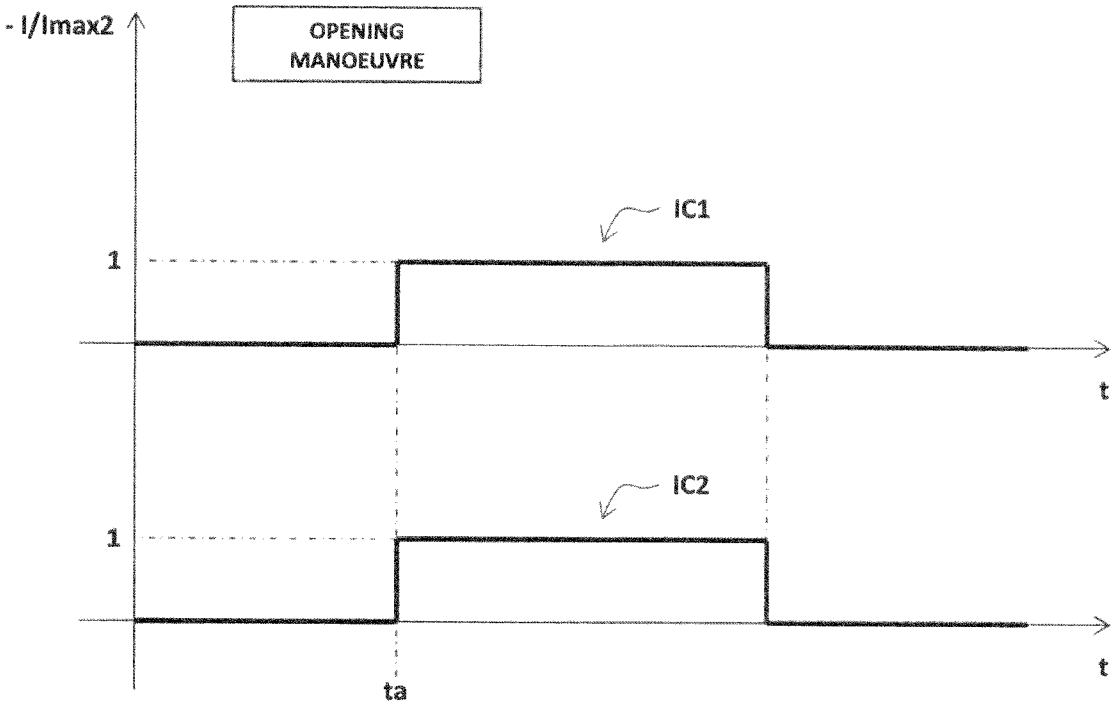

A possible driving strategy to drive the excitation coils 9, 10 to perform an opening manoeuver of the switching device 1 is shown in FIG. 14.

Conventionally, the excitation currents IC1, IC2 have a negative sign referring to the embodiment shown in FIG. 4.

According to this driving strategy, the first and second power drive circuits 21, 22 provide launch pulses of the first and second excitation currents IC1, IC2, which start at a same launch instant ta and which have a same amplitude (equal to the possible maximum amplitude for the opening manoeuvre, which can be different from the amplitude for the closing manoeuvre) and, preferably, a same duration.

In this way, during the opening manoeuvre, a good balance of the magnetic forces applied to the movable armature 5 is obtained and the completion of the opening manoeuvre in ensured.

More particularly, according to such a driving strategy:

- the first power drive circuit 21 provides a launch pulse of the first excitation current IC1 at a first launch instant ta. Said launch pulse of the first excitation current IC1 has an amplitude IL equal (100%) to the amplitude of the excitation current Imax2 needed to move the movable armature 5;
- the second power drive circuit 22 provides a launch pulse of the second excitation current IC2 at the first launch instant ta. Said launch pulse of the second excitation current IC2 has an amplitude IL equal (100%) to the amplitude of the excitation current Imax2 needed to move the movable armature 5 but equal to the amplitude and duration of the first launch pulse of the first excitation current ICE In normal conditions, both the excitation coils 9, 10 cooperate to generate the magnetic flux to move the movable armature 5 during the overlapping time (TL) between the launch pulses of the first and second excitation currents IC1, IC2.

It is evident that if a failure affecting one of the excitation coils 9, 10 occurs, the opening manoeuvre of the switching device is completed by the other excitation coil, which is not affected by failures, without any time delays.

According to some embodiments of the invention (FIGS. 15-17), the electromagnetic actuator 4 may be of a different type, as it comprises separate magnetic circuits for the closing manoeuvre and for the opening manoeuvre.

The electromagnetic actuator comprises a magnetic yoke having, in general, a "double comb" configuration.

The electromagnetic actuator 4 comprises an upper section including the vertical upper yoke portions 7A and the horizontal middle yoke portion 790 (referring to a normal operative position of the switching device).

The electromagnetic actuator 4 comprises the first and second excitation coils 9, 10 wound around one of the upper yoke portions 7A.

The electromagnetic actuator 4 comprises a lower section including the lower vertical yoke portions 7B and the middle yoke portion 790.

The electromagnetic actuator 4 comprises a third excitation coil 99 and a fourth excitation coil 109, which are wound around one of the lower yoke portions 7B.

According to these embodiments, the third excitation coil 99 and the fourth excitation coil 109 are used for the closing manoeuvre of the switching device, while the first excitation coil 9 and the second excitation coil 10 are used for the opening manoeuvre.

During a closing maneouvre, an excitation current in coil 99 or 109 generates a magnetic flux that circulates in the lower section of the actuator 4, namely along the permanent magnets 6, the yoke portions 79 and 790, the airgap 71 and the lower second plate 5B of the movable armature 5. Such a magnetic flux has the same direction with respect to the magnetic flux generated by the permanent magnets 6 and, by passing through the airgap 71, exerts a magnetic force on the second plate 5B of the movable armature 5 to close the airgap 71.

The movable armature 5 thus moves from the first position P1 to the second position P2.

Consequently, the movable contacts 3 move from the opening position OPEN to the closing position CLOSED.

During an opening maneouvre, an excitation current in coil 9 or 10 generates a magnetic flux that circulates in the upper section of the actuator 4, namely along the permanent magnets 6, the yoke portions 7A and 790, the airgap 72 and the upper first plate 5A of the armature 5.

Such a magnetic flux has also the same direction with respect to the magnetic flux generated by the permanent magnets 6 and, by passing through the airgap 72, exerts a magnetic force on the first plate 5A of the movable armature 5 to close the airgap 72.

The movable armature 5 thus moves from the second position P2 to the first position P1.

Consequently, the movable contacts 3 move from the closing position CLOSED to the opening position OPEN.

According to these embodiments of the invention, the switching device 1 further comprises a third power drive circuit 219 adapted to drive the third excitation coil 99 by providing a third excitation current IC3 to said third excitation coil and a fourth power drive circuit 229 adapted to drive the fourth excitation coil 109 by providing a fourth excitation current IC4 to said fourth excitation coil.

It is evidenced that the actuators 4, according to the embodiment of FIGS. 1-2, require power drivers that can change the direction of the current in the coils, as these actuators require different directions of currents for the closing and the opening manoeuver, respectively.

Figure 15:
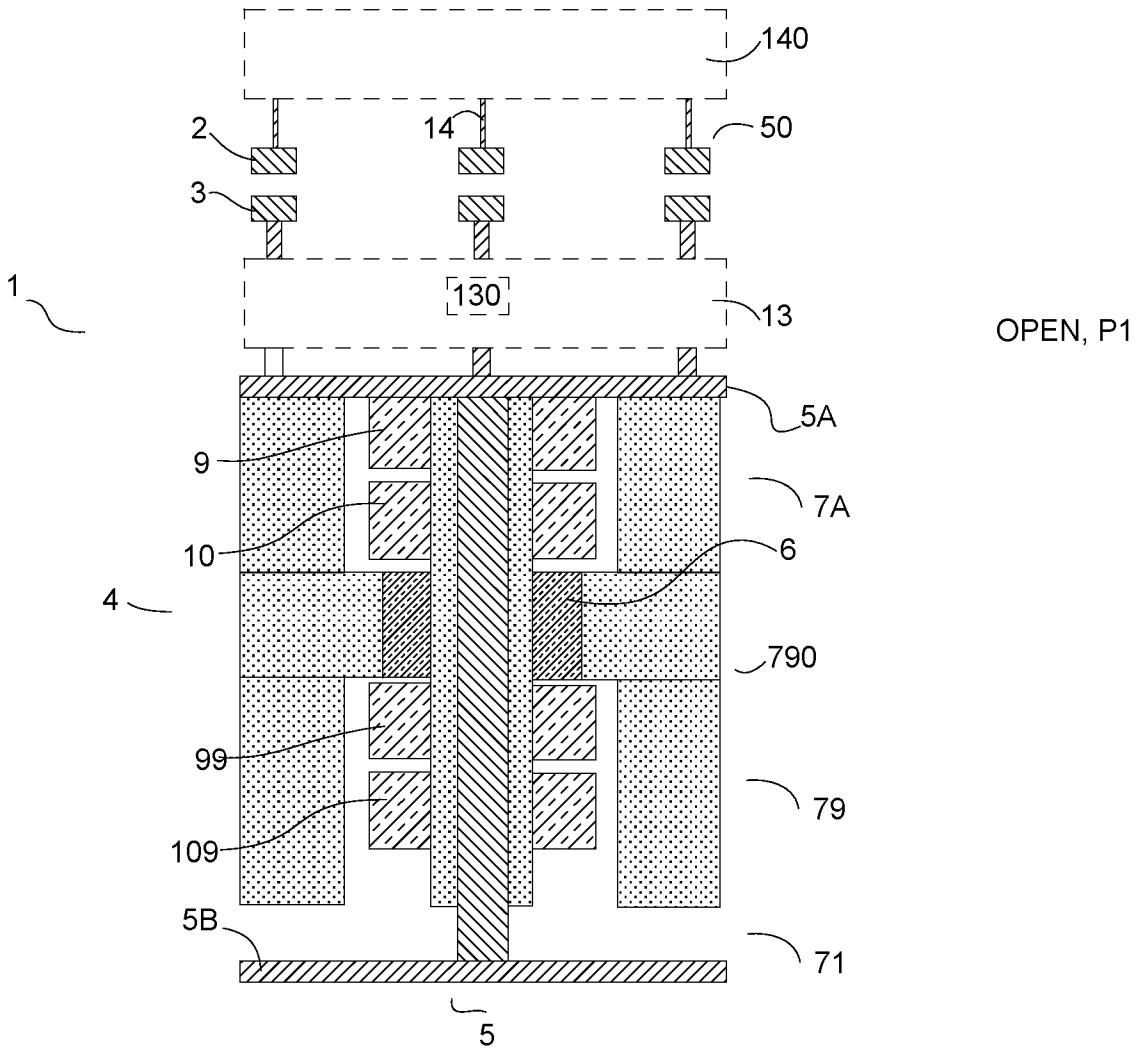
FIGS. 15-17 are block diagrams that schematically show a MV switching device, according to the invention, in a further embodiment.
Figure 16:
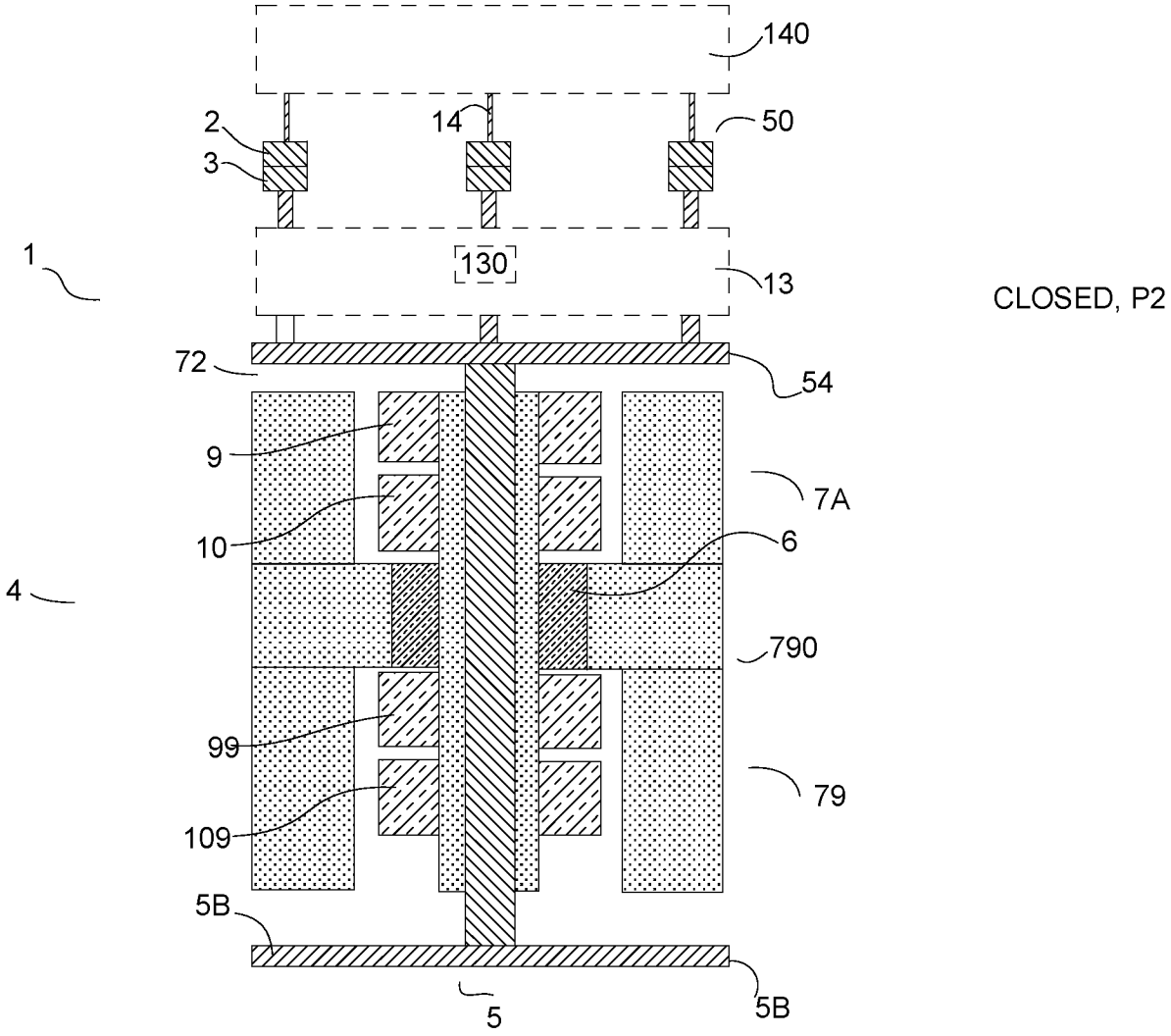
Figure 17:
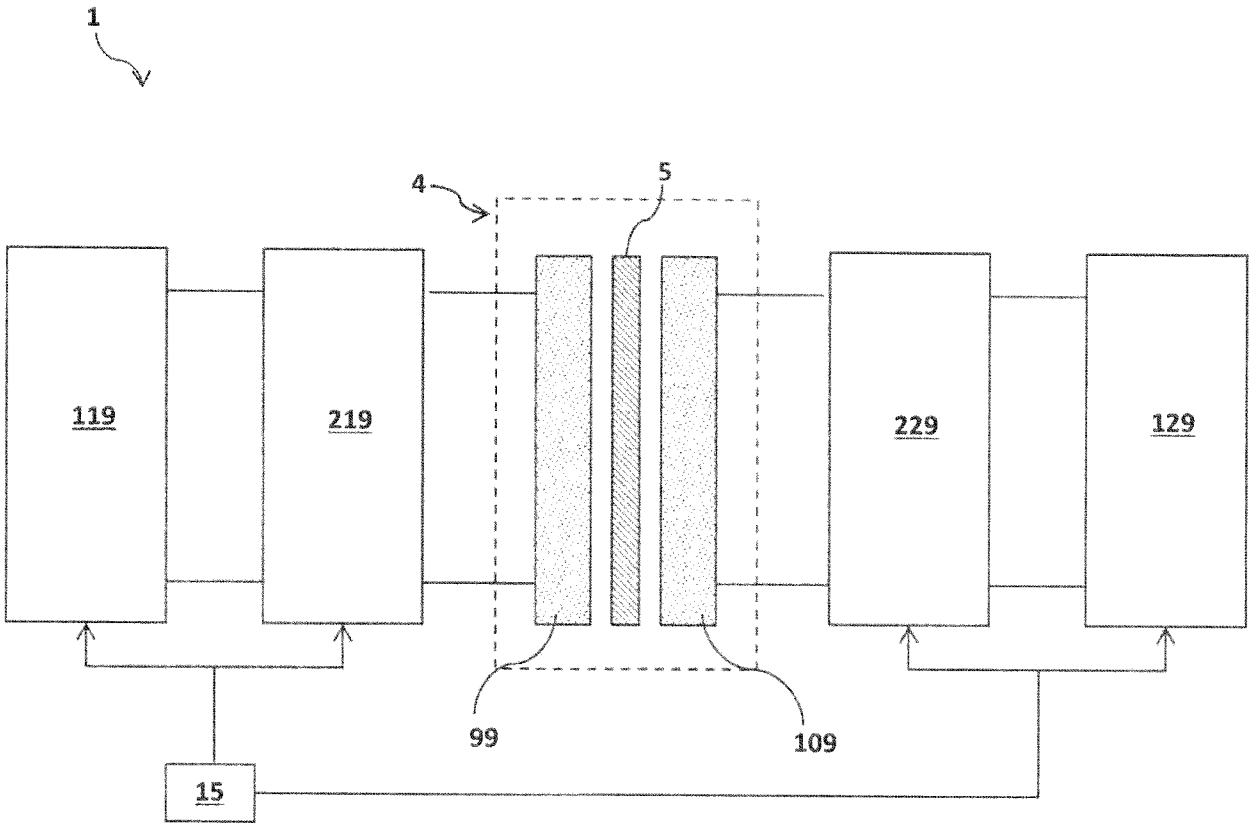

Instead, for the actuators 4 according to the embodiment of FIGS. 15-16, it is sufficient to use power drives that always drive current in the same direction, as in that case the distinction if a manoeuver is a closing or an opening manoeuver is made by the location of the coil and not by the direction of the current.

Conveniently, the third and fourth power drive circuits 219, 229 are galvanically separated one from another and capable to operate independently one from another and independently from the first and second drive circuits 21, 22 adapted to drive the excitation coils 9, 10.

Preferably, the switching device 1 comprises control means 119, 129 to control the third and fourth power drive circuits 219, 229.

Preferably, said control means comprises a third controller 119 to control the third power drive circuits 219 and a fourth controller 129 to control the fourth power drive circuit 229.

Other solutions are possible, according to the needs.

For example, the control means 119, 129 may comprise a single controller capable of controlling both the first, second, third, fourth power drive circuits 21, 22, 219, 229.

Preferably, the above described power supply means 15 are arranged to supply electric power to the control means 119, 129 and to the power drive circuits 219, 229 (and consequently to the excitation coils 99, 109).

The excitation coils 99, 109 are conveniently arranged similarly to the above described excitation coils 9, 10 and related power drive circuits 21, 22.

As an example, similarly to the excitation coils 9 and 10, the third and fourth excitation coils 99, 109 may have respective third and fourth turns arranged according to an interlaced winding layout or according to a concentric side-by-side winding layout.

The operation of excitation coils 99, 109 and the related power drive circuits 219, 229 is conveniently similar to the behaviour of the above described excitation coils 9, 10 and related power drive circuits 21, 22 except the excitation coils 9, 10 are exclusively used for the closing manoeuvre and that the excitation coils 99, 109 are exclusively used for the opening manoeuvre.

Preferably, each of the third and fourth drive circuits 219, 229 is adapted to drive the respective third excitation coil 99 or fourth excitation coil 109, so that the excitation current IC3 flowing along the third excitation coil 99 or the excitation current IC4 flowing along the fourth excitation coil 109 generates by itself a magnetic flux to move the movable armature 5 from the open position P1 to the closed position P2.

In more details:

the third drive circuit 219 is adapted to drive the third excitation coil 99 so that the excitation current IC3 flowing along this latter generates by itself a magnetic flux to move the movable armature 5 from the first position P1 to the second position P2, when the operation of the fourth excitation coil 109 is affected by a failure (e.g. by a failure in the fourth excitation coil 109 itself and/or in the fourth power drive circuits 229 and/or in the fourth controller 129);

the fourth drive circuit 229 is adapted to drive the fourth excitation coil 109 so that the fourth excitation current IC4 flowing along this latter generates by itself a magnetic flux to move the movable armature 5 from the first position P1 to the second position P2, when the operation of the third excitation coil 99 is affected by a failure (e.g. by a failure in the third excitation coil 99 itself and/or in the third power drive circuits 219 and/or in the third controller 119).

The control means 119, 129 are preferably configured to control the power drive circuits 219, 229 so that the excitation coils 99, 109 are driven according to redundant driving strategies by the power drive circuits 219, 220 to perform opening or closing manoeuvers of the switching device.

Said redundant driving strategies may be, mutatis mutandis, fully similar to the driving strategies described above.

The MV switching device 1, according to the present invention, offers relevant advantages with respect to the available solutions of the state of the art.

As it is provided with redundancy arrangements to energize the electromagnetic actuator 4, the MV switching device 1 ensures high reliability levels in operation.

On the other hand, said redundancy arrangement does not entail any complication in the design of the other parts or components of the switching device, in particular of the kinematic chain 13.

The switching device 1 is characterised by a compact structure that is relatively easy and cheap to manufacture at industrial level.

The switching device 1 is particularly suitable for MV electric power distribution installations arranged in critical environments or, in general, requiring top-level performances in terms of reliability.

In a further aspect, the present invention relates to an electric power distribution installation including the switching device 1, as described above.

In yet a further aspect, the present invention relates to a subsea electric power distribution installation (such as a subsea electric power switchgear) including the switching device 1, as described above.

The invention claimed is:

1. A switching device comprising:

one or more fixed contacts and one or more movable contacts, each movable contact being reversibly movable between an opening position, at which said movable contact is decoupled from a corresponding fixed contact, and a closing position, at which said movable contact is coupled with the corresponding fixed contact;

an electromagnetic actuator adapted to move said movable contacts between said opening and closing positions, said electromagnetic actuator comprising a fixed yoke and a movable armature operatively associated with said fixed yoke to form a magnetic circuit, said movable armature being reversibly movable between a first position, which corresponds to the opening position of said movable contacts, and a second position, which corresponds to the closing position of said movable contacts;

a kinematic chain to operatively connect said movable armature with said movable contacts;

wherein said electromagnetic actuator comprises a first excitation coil and a second excitation coil wound around a first section of said fixed yoke and in that said switching device further comprises a first power drive circuit adapted to drive said first excitation coil by providing a first excitation current to said first excitation coil and a second power drive circuit adapted to drive said second excitation coil by providing a second excitation current to said second excitation coil, said first and second power drive circuits being galvanically separated one from another and capable of operation independently one from another, wherein said control means are configured to control said first and second power drive circuits so that, to perform a closing manoeuvre of said switching device;

said first power drive circuit provides a launch pulse of said first excitation current to said first excitation coil at a first launch instant, said launch pulse of said first excitation current having an amplitude lower than the amplitude of an excitation current needed to move said movable armature;

said second power drive circuit provides a launch pulse of said second excitation current to said second excitation coil at said first launch instant, the launch pulses of said first and second excitation currents having a same amplitude and duration, and wherein said control means are configured to control said first and second power drive circuits so that:

if operation of said first excitation coil is affected by a failure, said second power drive circuit provides a further launch pulse of said second excitation current to said second excitation coil at a second launch instant following said first launch instant, said further launch pulse of said second excitation current having an amplitude equal to the amplitude of the excitation current needed to move said movable armature; or if operation of said second excitation coil is affected by a failure, said first power drive circuit provides a further launch pulse of said first excitation current to said first excitation coil at a second launch instant following said first launch instant, said further launch pulse of said first excitation current having an amplitude equal to the amplitude of the excitation current needed to move said movable armature.

2. The switching device, according to claim 1, wherein said first and second power drive circuits are adapted to drive said first and second excitation coils so that the excitation currents provided to said first and second excitation coils cooperate to generate a magnetic flux to move said movable armature between said first and second positions, when operation of said first and second coils is not affected by a failure.

3. The switching device, according to claim 2, wherein:

said first power drive circuit is adapted to drive said first excitation coil so that the first excitation current provided to said first excitation coil generates by itself a magnetic flux to move said movable armature between said first and second positions, when operation of said second excitation coil is affected by a failure;

said second power drive circuit is adapted to drive said second excitation coil so that the second excitation current provided to said second excitation coil generates by itself a magnetic flux to move said movable armature between said first and second positions, when operation of said first excitation coil is affected by a failure.

4. The switching device, according to claim 1, wherein said electromagnetic actuator comprises one or more permanent magnets to generate a bias magnetic flux to maintain said movable armature in said first position or in said second position.

5. The switching device, according to claim 1, wherein said first and second excitation coils have respectively first and second turns arranged according to an interlaced winding layout.

6. The switching device, according to claim 1, wherein said first and second excitation coils have respectively first and second turns arranged according to a concentric side-by-side winding layout.

7. The switching device, according to claim 1, wherein it comprises control means to control said first and second power drive circuits.

8. The switching device, according to claim 1, wherein said first and second launch instants being separated by a time interval shorter than the duration of the first one of the launch pulses of said first and second excitation currents.

9. The switching device, according to claim 8, wherein said time interval is longer than or equal to the closing time of said switching device.

10. The switching device, according to claim 1, wherein said launch pulse of said second excitation current needed to move said movable armature.

11. The switching device, according to claim 1, wherein said electromagnetic actuator comprises a third excitation coil and a fourth excitation coil wound around a second section of said fixed yoke and in that said switching device further comprises a third power drive circuit adapted to drive said third excitation coil by providing a third excitation current to said third excitation coil and a fourth power drive circuit adapted to drive said fourth excitation coil by providing a fourth excitation current to said fourth excitation coil, said third and fourth power drive circuits being galvanically separated one from another and capable of operating independently one from another.

12. The switching device, according to claim 11, wherein:

said third and fourth drive circuits are adapted to drive said third and fourth excitation coils so that the excitation currents provided to said third and fourth excitation coils cooperate to generate a magnetic flux to move said movable armature from said first position to the said second position;

said first and second drive circuits are adapted to drive said first and second excitation coils so that the excitation currents provided to said first and second excitation coils cooperate to generate a magnetic flux to move said movable armature from said second position to the said first position.

13. The switching device, according to claim 12, wherein:

said third drive circuit is adapted to drive said third excitation coil so that the third excitation current provided to said third excitation coil generates by itself a magnetic flux to move said movable armature from said first position to the said second position, when operation of said fourth excitation coil is affected by a failure;

said fourth drive circuit is adapted to drive said fourth excitation coil so that the fourth excitation current provided to said fourth excitation coil generates by itself a magnetic flux to move said movable armature from said first position to the said second position, when operation of said third excitation coil is affected by a failure.

14. The switching device, according to claim 13, wherein said third and fourth excitation coils have respectively third and fourth turns arranged according to an interlaced winding layout.

15. The switching device, according to claim 11, wherein said third and fourth excitation coils have respectively third and fourth turns arranged according to a concentric side-by-side winding layout.

16. An electric power distribution installation further comprising a switching device, according to claim 1.

17. The electric power distribution installation, according to claim 16, wherein it is a subsea electric switchgear.

18. The switching device, according to claim 11, wherein:

said third and fourth drive circuits are adapted to drive said third and fourth excitation coils so that the excitation currents provided to said third and fourth excitation coils cooperate to generate a magnetic flux to move said movable armature from said first position to the said second position-;

said first and second drive circuits are adapted to drive said first and second excitation coils so that the excitation currents provided to said first and second excitation coils cooperate to generate a magnetic flux to move said movable armature from said second position to the said first position.

* * * * *